United States Patent [19]

Stuckmayer

[11] Patent Number: 4,557,486

[45] Date of Patent: Dec. 10, 1985

[54] FARM GAME

[76] Inventor: Jack Stuckmayer, 1102 Delaware Ave., West St. Paul, Minn. 55118

[21] Appl. No.: 631,390

[22] Filed: Jul. 16, 1984

[51] Int. Cl.[4] ..... A63F 3/00; A63F 9/04

[52] U.S. Cl. ..... 273/278; 273/145 B

[58] Field of Search ..... 273/278, 256, 145 B, 273/145 C, 144 B

[56] References Cited

U.S. PATENT DOCUMENTS

| | | | |
|---|---|---|---|
| 2,255,455 | 9/1941 | Shertzer | 273/144 B |
| 2,299,284 | 10/1942 | Steidemann | 273/278 X |
| 2,985,453 | 5/1961 | Matisz | 273/145 C |
| 3,589,728 | 6/1971 | McFarland | 273/144 B X |
| 3,865,380 | 2/1975 | Thomas | 273/256 |
| 4,162,073 | 7/1979 | Norris | 273/144 B |
| 4,368,887 | 1/1983 | Gamble | 273/144 B |

FOREIGN PATENT DOCUMENTS

| | | | |
|---|---|---|---|
| 425587 | 10/1947 | Italy | 273/145 C |
| 645804 | 11/1950 | United Kingdom | 273/278 |
| 2001251 | 1/1979 | United Kingdom | 273/256 |
| 2021423 | 12/1979 | United Kingdom | 273/256 |

OTHER PUBLICATIONS

*Science Teacher Magazine,* Apr. 1973, p. 59.

*Primary Examiner*—Richard C. Pinkham
*Assistant Examiner*—Scott Brown
*Attorney, Agent, or Firm*—Orrin M. Haugen; Thomas J. Nikolai

[57] ABSTRACT

A farm game having a price board, dice silo, money, farm record sheets, homestead plats and various commodities. The dice silo displays a chance selected die with a marked subdivision of the silo face plate, and the price board is divided into sections equal in number to the dice in the silo. The dice set a price or quote marked on the price board from which the players conduct transactions.

1 Claim, 9 Drawing Figures

| | YEAR FOUR | | | | | | YEAR FIVE | | | | | |
|---|---|---|---|---|---|---|---|---|---|---|---|---|
| | BUY | | | SELL | | | BUY | | | SELL | | |
| | QUAN. | ITEM | AMT. | QUAN. | ITEM | AMT. | QUAN. | ITEM | AMT. | QUAN. | ITEM | AMT. |
| WINTER | | | $ 000 | | | $ 000 | | | $ 000 | | | $ 000 |
| | | | 000 | | | 000 | | | 000 | | | 000 |
| | | | 000 | | | 000 | | | 000 | | | 000 |
| | | | 000 | | | 000 | | | 000 | | | 000 |
| | | | 000 | | | 000 | | | 000 | | | 000 |
| SPRING | LAND TAX | | 000 | MILK | | 000 | LAND TAX | | 000 | MILK | | 000 |
| | | | | EGGS | | 000 | | | | EGGS | | 000 |
| | | | 000 | | | 000 | | | 000 | | | 000 |
| | | | 000 | | | 000 | | | 000 | | | 000 |
| | | | 000 | | | 000 | | | 000 | | | 000 |
| | | | 000 | | | 000 | | | 000 | | | 000 |
| | | | 000 | | | 000 | | | 000 | | | 000 |
| SUMMER | | | 000 | | | 000 | | | 000 | | | 000 |
| | | | 000 | | | 000 | | | 000 | | | 000 |
| | | | 000 | | | 000 | | | 000 | | | 000 |
| | | | 000 | | | 000 | | | 000 | | | 000 |
| | | | 000 | | | 000 | | | 000 | | | 000 |
| FALL | LAND TAX | | 000 | MILK | | 000 | LAND TAX | | 000 | MILK | | 000 |
| | LOAN INTEREST | | $ 5,000 | EGGS | | 000 | LOAN INTEREST | | $ 5,000 | EGGS | | 000 |
| | | | 000 | | | 000 | | | 000 | | | 000 |
| | | | 000 | | | 000 | | | 000 | | | 000 |
| | | | 000 | | | 000 | | | 000 | | | 000 |
| | | | 000 | | | 000 | | | 000 | | | 000 |
| | | | 000 | | | 000 | | | 000 | | | 000 |

FINAL RECKONING 160

| QUAN. | ITEM | @ | AMT. |
|---|---|---|---|
| | CHICKENS | | $ 000 |
| | COWS | | 000 |
| | BEEF | | 000 |
| | HOGS | | 000 |
| | WHEAT | | 000 |
| | CORN | | 000 |
| | SOYBEANS | | 000 |
| | COOPS (HALF PRICE) | | 000 |
| | BARNS ( " " ) | | 000 |
| | BEEF SHEDS ( " " ) | | 000 |
| | HOG SHEDS ( " " ) | | 000 |
| | FIELD EQUIP. ( " " ) | | 000 |
| | EXTRA LAND (FULL PRICE) | | 000 |
| CASH ON HAND | | | 000 |
| TOTAL | | | 000 |
| LESS LOAN | | | $ 50,000 |
| FINAL TOTAL | | | 000 |

60

Fig. 6b

FARM GAME

BACKGROUND OF THE INVENTION

The present invention relates generally to games, and more particularly to a unique game which realistically simulates the management decisions required to operate a farm.

While the prior art does include numerous games which have been developed to simulate various economic activities (see, for example, U.S. Pat. Nos. 4,040,629 and 1,132,403) as well as games having certain aspects of farming as their subject matter (see, for example, U.S. Pat. No. 1,365,863), none of these games relate specifically to farm management or provide sufficient flexibility to select between a variety of tactics to accurately simulate the management of a farm.

The game of the present invention overcomes the above-described deficiencies by permitting the game players to purchase and sell such items as land, buildings, animals, field equipment and crops. Players initially borrow money to finance purchases. Players may even go bankrupt. To insure accurate simulation of a fram's operation, the game requires players to pay off loans, pay taxes, collect income from sales, purchase sufficient land and buildings to care for the farm animals they purchase, purchase sufficient equipment to care for the farm itself, all while dealing with fluxuating prices and depreciation of buildings and equipment. The game is designed to be simple enough so that children can play while at the same time sophisticated enough to entertain adults.

SUMMARY OF THE INVENTION

Briefly, the game apparatus of the present invention includes a price board, a dice silo, a bank, money, farm record sheets, homestead plats, and various commodities. At the beginning of the game, each player is given a homestead, a farm sheet and a $50,000 cash loan from the bank. The dice silo is used to determine the current prices of the various commodities. The prices are then marked on the price board. Players are free to buy and sell land, animals, buildings, or crops as they see fit. They must also pay interest on the initial loan and land taxes at various points in the game. As the game progresses, the dice silo is used to establish price changes and trading continues. At the end of a specified number of seasons, the game ends and the winner is the individual with the greatest net worth as determined by the farm record sheets.

Accordingly, a primary object of the present invention is to provide a new and improved game apparatus which realistically simulates the financial conditions and practical considerations which must be taken into account in managing a farm.

Another object of the present invention is to provide new and improved apparatus which realistically simulates the various factors and influences normally encountered by farmers in managing a farm.

Still another object of the present invention is to provide a new and improved apparatus which realistically simulates the various factors and influences normally encountered by farmers in managing a farm and which may be played by both children and adults.

Other objects and advantages of the invention will become apparent as the foregoing description proceeds, taken together with the accompanying drawings and the appended claims.

DESCRIPTION OF THE DRAWINGS

The present invention and many of the attendant advantages thereof will be readily apprecited as the same becomes better understood by reference to the following detailed description when considered in connection with the accompanying drawings in which.

Figure 7:
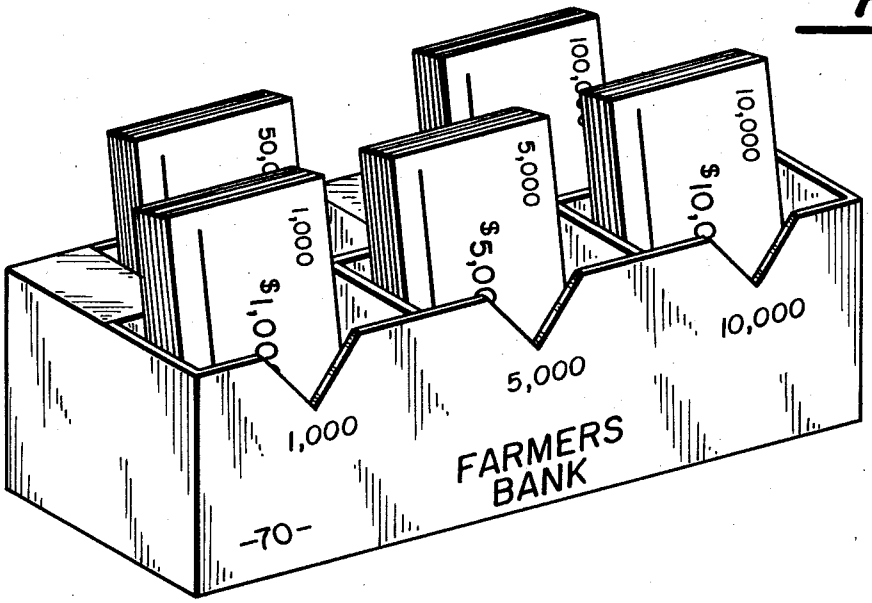

FIGS. *6a* and *6b* is a plane view of a farm record sheet;

FIG. 7 is a plane view of the bank; and

Figure 8:
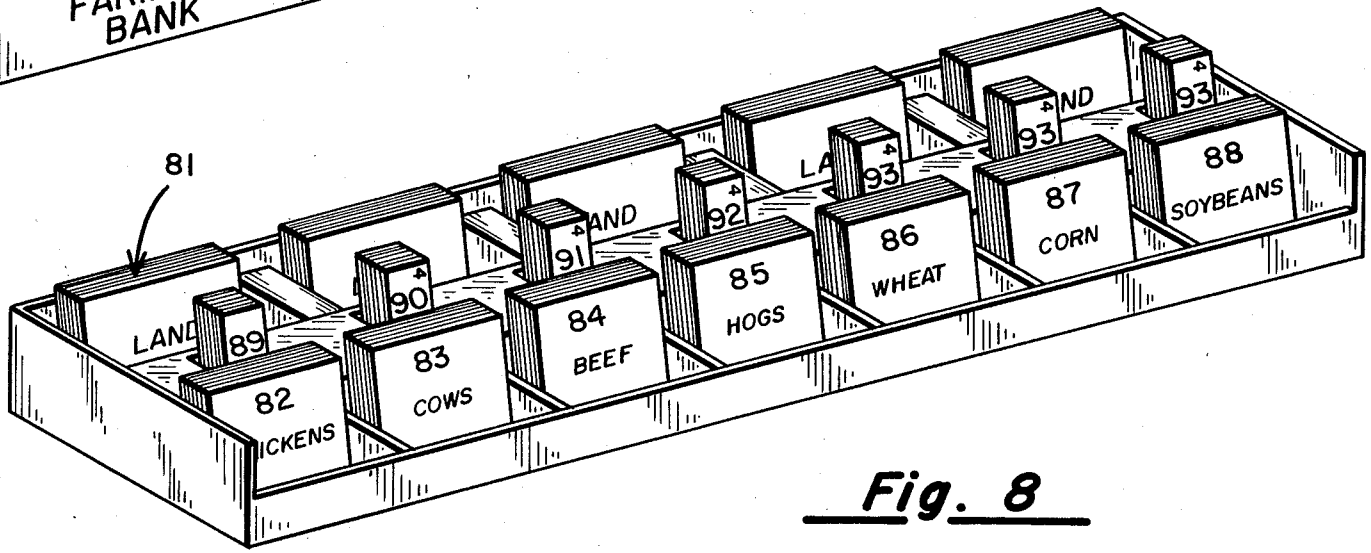

FIG. 8 is a plane view of a commomdities storage rack.

DESCRIPTION OF THE PREFERRED EMBODIMENT

The game of the present invention is intended to be played by two or more players who are called farmers. As the game is being played, the farmers buy chickens and cows and collect eggs and milk money, plant and harvest crops, and trade in beef and hogs. Farmers may show a profit or a loss, or even go bankrupt. Each individual farmer can decide what specific strategy to undertake. He can play cautiously or with reckless abandon. The winner is the farmer who makes the most money at the end of a five-year period.

Before the game begins, the farmers select a banker and a commodity dealer. Each farmer is then given a homestead card 50 (see FIG. 5), a farm record sheet 60 (see FIGS. *6a* and *6b*) and a $50,000.00 loan in play money from the bank 70 (see FIG. 7). The homestead consists of a 160 acres of land 51 (divided into four 40's labeled **51*a*, 51*b*, 51*c* and 51*d*) with a chicken coop 52, dairy barn 53, beef shed 54, hog shed 55, field equipment 56, a seed storage area 57, a harvest storage area 58, and space for extra buildings and equipment 59**. During the course of the game, the homesteads themselves may not be bought or sold, but they may be added on to.

The front of the farm record sheet 60 shown in FIG. *6a* and the back of the farm record sheet 60 is shown in FIG. *6b*. The farm record sheet, which is used to record all transactions undertaken by the individual farmer, will be discussed in greater detail below.

Other equipment necessary to play the game includes a dice silo 10 and stand 20 (see FIGS. 1 and 2); a price board 30 and stand 40 (see FIGS. 3 and 4); various commodity cards 80 (representing land 81, chickens 82, cows 83, beef 84, hogs 85, wheat 86, corn 87, soybean 88, chicken coops 89, dairy barns 90, beef sheds 91, hog sheds 92 and field equipment 93 (see FIG. 8); a bank 70 (see FIG. 7); and play money in $1,000.00, $5,000.00, $10,000.00, $50,000.00 and $100,000.00 denominations.

Figure 1:
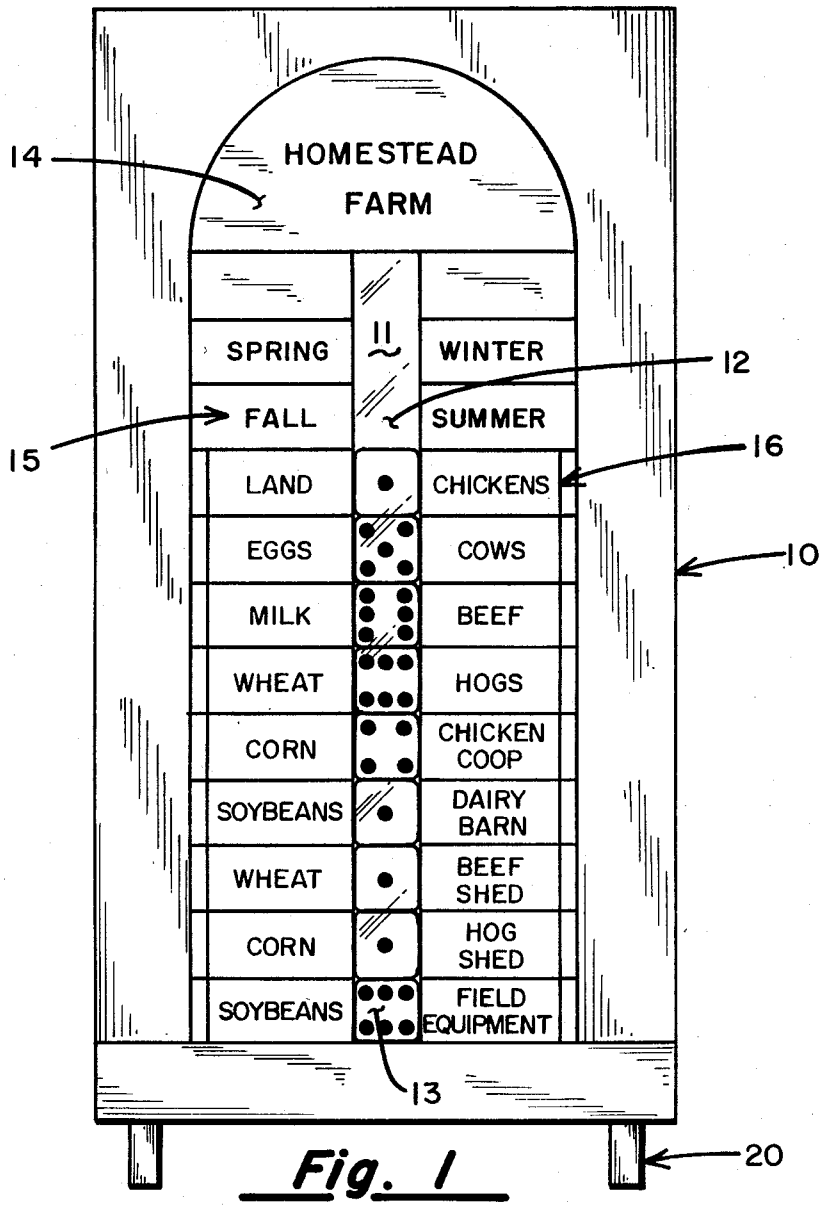
FIG. 1 is a plane view of the dice silo of the present invention.

As stated above, FIG. 1 is a plane view of the front of the dice silo 10. Shown in the drawing are a dice receiving chamber 11 having a clear front 12, nine dice 13 which vertically align themselves in the dice receiving chamber 11, and a faceplate 14 which is divided into two columns of subdivisions 15 and 16, one such column 15 being to the left of the dice receiving chamber and the other column 16 being to the right of the dice receiving chamber. Each of the nine lowest subdivisions of the two columns 15 and 16 have the same height as a single die so as the dice 13 drop into the receiving chamber 11, they align themselves with the subdivisions.

Figure 2:
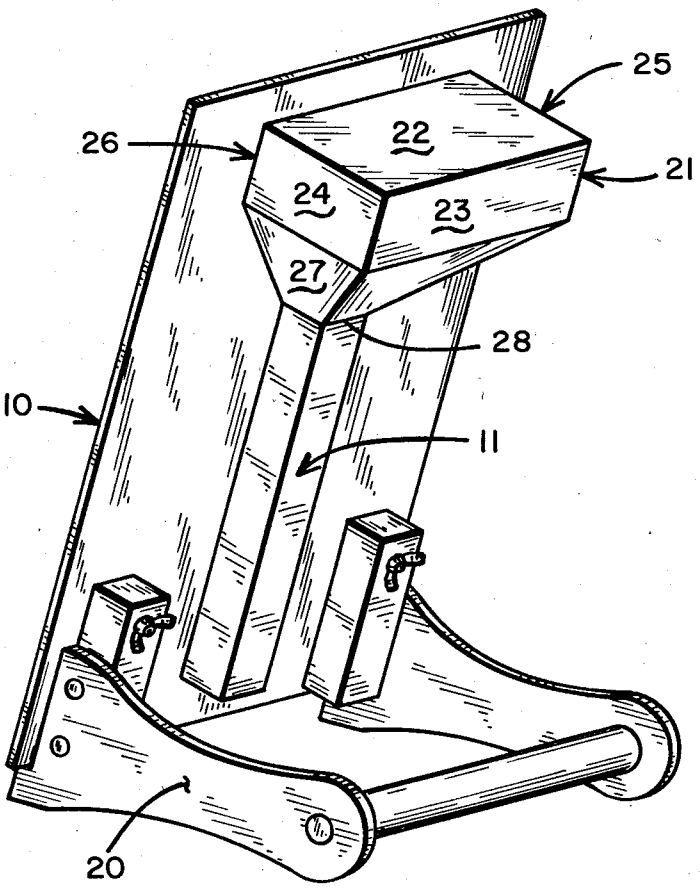
FIG. 2 is a rear view of the dice silo and its stand.

FIG. 2 shows is a perspective view of the backside of the dice silo 10. Shown at 20 is the stand which holds the dice silo in essentially vertical configuration. Shown at 21 is the dice storage and shaker chamber which has a flat rectangular top 22, four rectangular sides 23-26 and a frusto-pyramidal base 27 which opens at 28 into the top of the dice receiving chamber 11. When in use, the dice silo 10 is tipped upside down so that the dice 13, by a gravity, move into the storage and shaking chamber 21. The dice 13 are then agitated and the silo 10 is tipped rightside up and placed on a flat horizontal playing surface. The dice 13, again by force of gravity, align themselves in a vertical array in the dice receiving chamber 11 so that the nine dice 13 are associated with the lowest nine subdivisions of each of columns 15 and 16 on faceplate 14.

Figure 3:
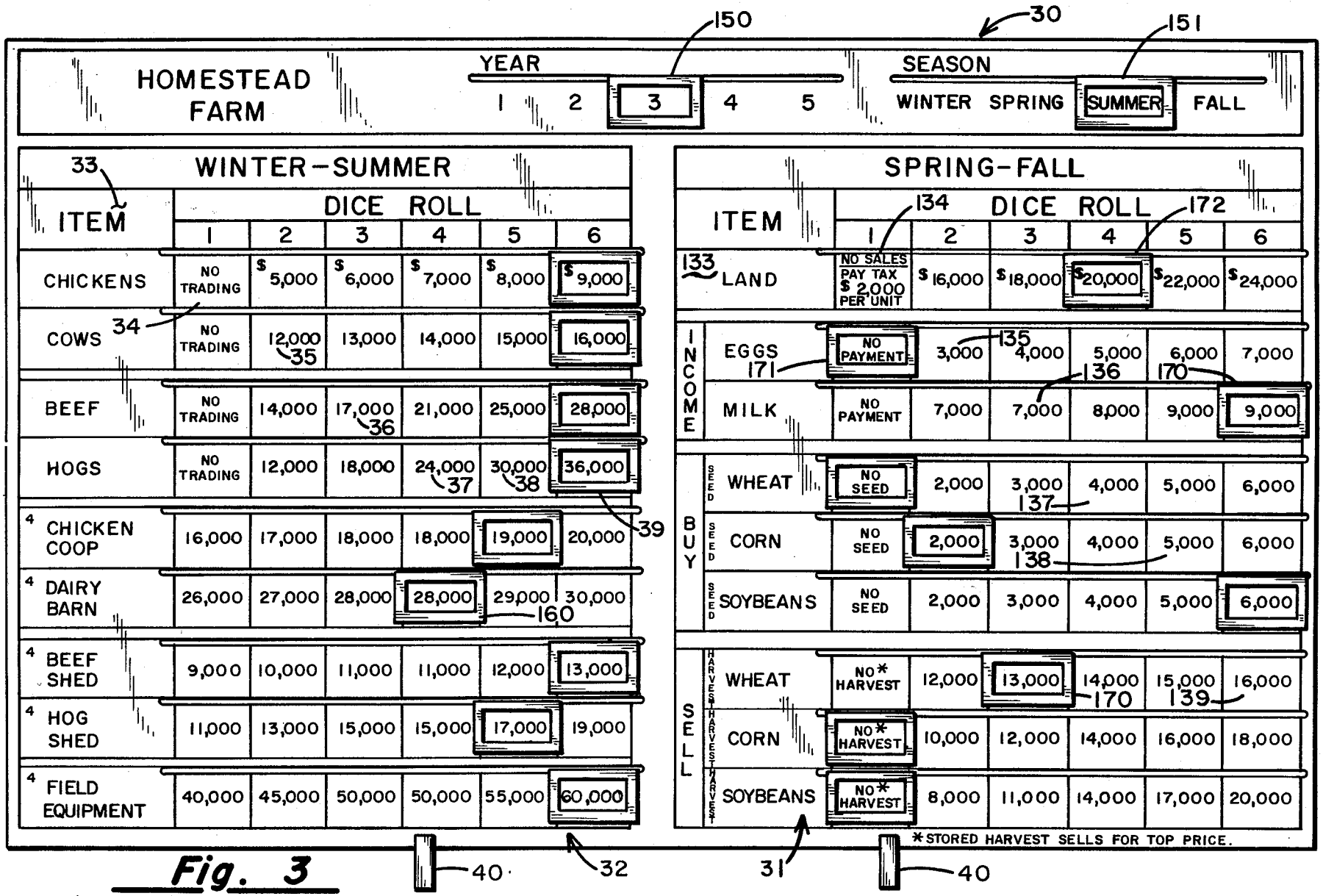
FIG. 3 is a plane view of the price board of the present invention.

FIG. 3 is a plane view of the price board 30. The board has rectangular metal markers which denote the year, the season and the commodity prices which are determined by the dice silo. The main portion of the board is divided into two sections, a right side 31 and a left side 32. The left side 32 of the price board is divided into seven vertical columns 33-39. Column 33 contains a listing of nine commodities. This listing is identical to the listing on column 16 of the dice silo 10. The remaining six columns (34–39) are numbered one through six and contain the prices at which the various commodities are determined. Metal markers such as 160 are moved from column to column to reflect the current market price for each commodity as the prices change throughout the game. As should already be apparent, the numbers on the top of columns 34–39 are intended to correspond to the number of dots on the dice 13 which could possibly show through the clear front 12 of the dice receiving chamber 11 of the disc silo 10. Thus, if the dice silo 10 appears as it does in FIG. 1, there would be no trading for chickens; cows would cost %15,000,00; beef would cost $28,000.00; hogs would cost $36,000.00; chicken coops would cost $18,000.00; dairy barns would cost $26,000.00; beef sheds would cot $9,000.00, hog sheds would cost $11,000.00; and field equipment would cost $60,000.00.

The right-hand side 31 of the price board 30 is also divided into seven vertical columsn 133–139. Column 133 contains a listing of nine commodities which, this time, corresponds to the listing on column 15 on the left side of the dice silo 10. The remaining columns 134–139 are again numbered one through six and contain the prices at which the various commodities may be sold. Metal markers such as 170 are used to reflect the current market price. The roll of the dice 13 in the dice silo 10 determines the appropriate position for each marker.

Figure 4:
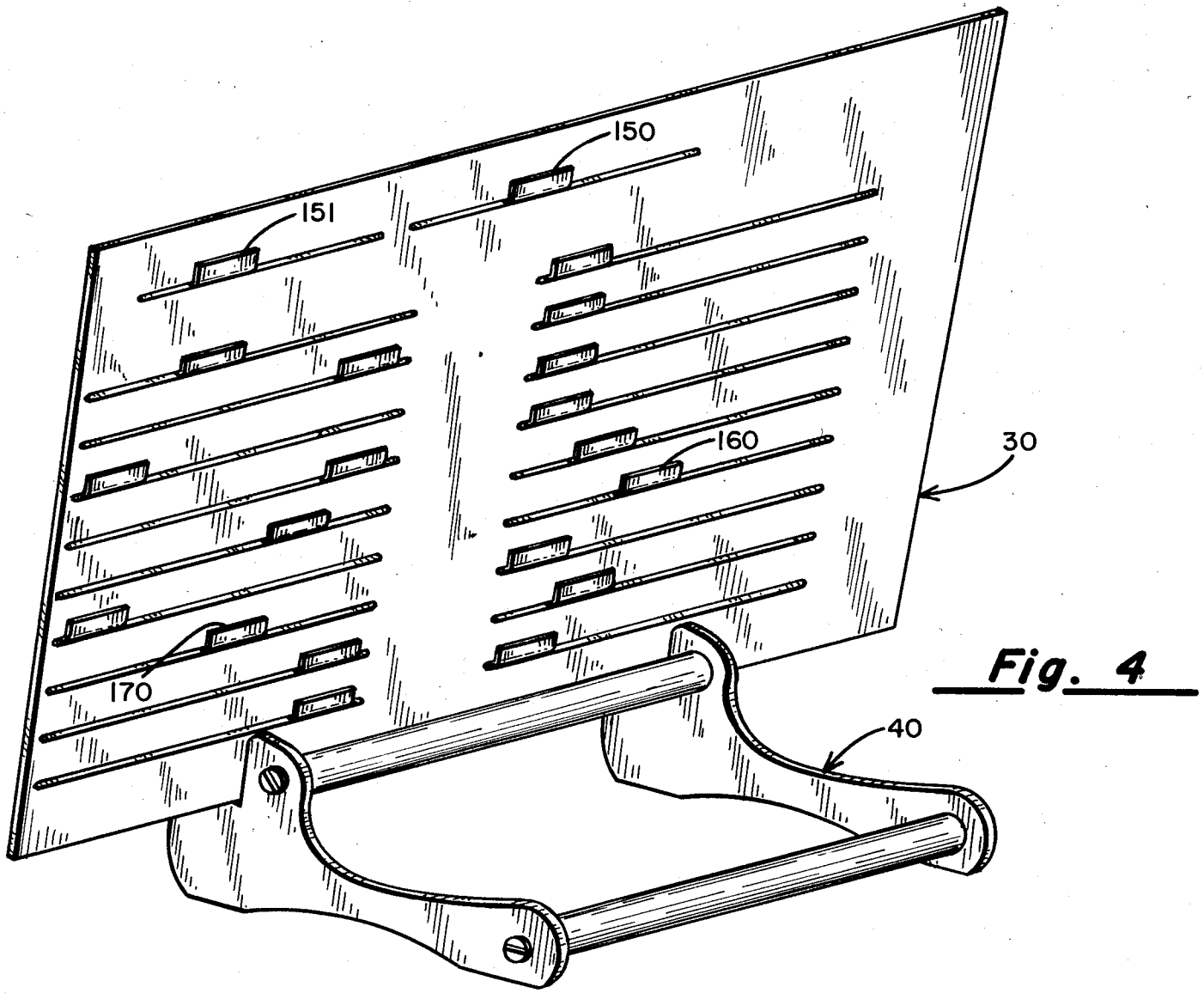
FIG. 4 is a rear view of the price board and its stand.

FIG. 4 is a perspective view of the backside of the price board 30 showing the stand which maintains the price board in a vertical position and the manner in which the markers are maintained in assembled relation with the board.

To begin the game, the year marker 150 on the price board 30 should be set on one and the season marker 151 on the price board should be set on winter. The dice silo 10 should be used as described above to determine the prices for the winter of year one and placed to the left of the price board 30. The commodities dealer should then mark the prices as indicated on the dice silo 10 on the left half 32 of the price board 30. Markers 160 are in the proper position on the left half and properly reflect the current prices if the dice 13 in the dice silo 10, from the bottom up, show six, five, six, four, five, six, six, six, and six dots respectively, through clear front 12.

Once the prices have been established by the dice silo 10 and set on the price board 30, each farmer may use his $50,000.00 loan to buy whichever commodities listed in column 32 on the left half of the price board 30 he wants for his homestead except those commodities which have been marked "no trading" as a result of the roll of the dice 13. The money is paid to the banker and the commodities (represented by cards) are obtained from the commodites dealer.

Figure 5:
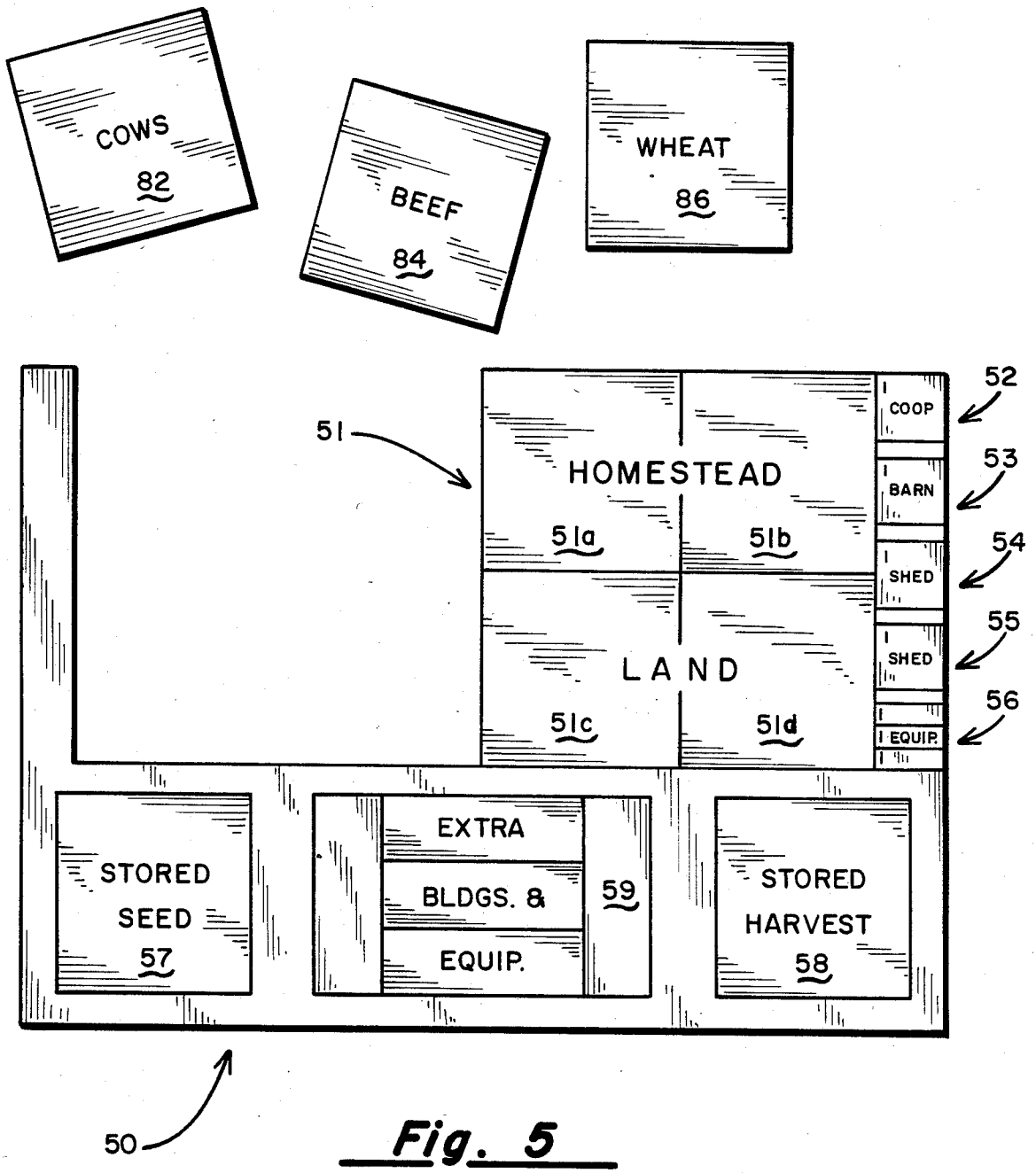
FIG. 5 is a plane view of an example homestead plat.
Figure 6A:
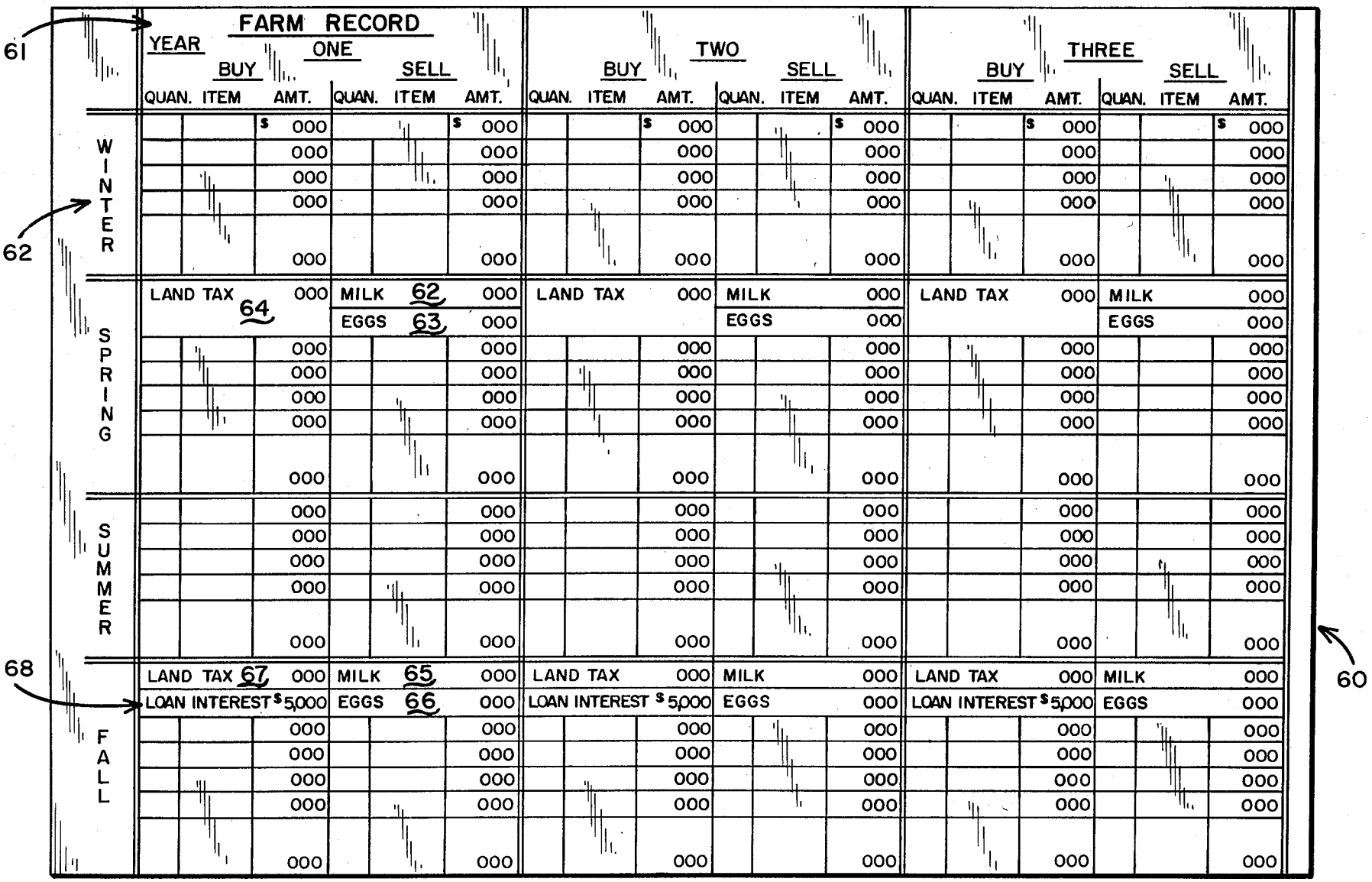

When commodities are obtained, they are to be placed on the homestead plat shown in FIG. 5. Each livestock unit (82–85) is to be placed on an empty forty of **51*a*-51*d*, and extra buildings (82–92) and equipment 93, if any, are to be placed on the various spaces provided. The transactions are then recorded on the farm record sheet 60 in the far left column 61 in the section 62** marked "winter". Each farmer buys and sells when he is ready and there is no set order of turns.

In order to more accurately simulate farm management techniques, the game rules provide that each homestead 50 contains enough buildings for one unit of each livestock (i.e., chickens 82, cows 83, beef 84 and hogs 85). For example the homestead dairy barn 53 and one forty of land accommodate one unit of cows 83. Additional units of cows 83 will generally require an accompanying purchase of additional land 81 and/or an extra dairy barn 90. A farmer may not buy livestock without first having adequate land and buildings for them.

When all of the players have completed the various transactions that they wish to make in the winter of the first year and the transactions have been recorded on the farm record sheets 60, the price board's season marker 151 is set on spring and the year marker 150 is left on one. The dice 13 in the dice silo 10 are again shaken to determine the prices for the spring of year one and the dice silo 10 is placed to the right of the price board 30. The commodities dealer then marks the right half 31 of the board 30 based on the dice roll. In the example shown in FIG. 3, the prices have been correctly marked if the dice 13, from the bottom of the dice silo 10, read one, three, six, two, one, six, one, and four. The banker than pays milk money in the amount indicated by the marker 170 to those farmers owning cows and egg money in the amount indicated by marker 171 to farmers who own chickens. The total payment to each farmer is the amount reflected by the marker 170 multiplied by the number of units of cows he owns plus the amount reflected by marker 171 multiplied by the number of units of chickens he owns. Receipts of milk and egg money in the spring of year one are recorded on the farm record sheet at 62 and 63 respectively.

The banker then collects from each player land taxes if the land marker 172 on the price board is set on column 134. The land tax is $8,000.00 for a homestead plus $2,000.00 for each extra forty of land that the farmer owns. Tax payments for the spring of year one are also recorded on the farm record sheet at 64.

At this point in the game, both sides of the price board 30 are in play and the farmers may buy and sell from either side of the price board 30. As transactions are completed, they are recorded on the farm record sheet 60. Under the game rules, a farmer may not buy and sell commodities marked "no trading" and may not sell commodities that have not had a new dice roll since the farmer purchased them. For example, a farmer may not buy a unit of cows in the winter, collect milk money the next spring, and then sell the cows the sampe spring. The farmer must wait for at least one new diceroll before selling the cows. Also, seed may never be sold back, it only may be sold as a harvested crop. While it is possible under the game rules to sell back extra buildings and field equipment at any time, it is only possible to do so at one-half the price on the price board at the time of sale.

Further, under the game rules, spring is the only season in which farmers may elect to plant seeds. If they decide to plant seed, it must remain on the land through spring and summer to be eligible for harvest and sale in the fall. Only one unit of seed may be planted on any particular forty of land which is not already in use. At the start of the game, each player was furnished with enough field equipment to plant and harvest one unit of each crop (wheat, corn and soybeans). If the farmer decides to plant more than one unit of any particular crop, the farmer must buy extra field equipment and sufficient unused land to handle the combination of crops he wishes to plant. There is, of course, no limit to the number of buildings, equipment, land, livestock or crops that a farmer may have.

Another option available to farmers under the game rules is to buy seed 86–88 in advance and store it in the homestead seed storage area 57 rather than plant it immediately. This is a good way to take advantage of low seed prices and to protect against future dice rolls of "no seed".

Once all of the players have completed and recorded their spring transactions on farm record sheet 60, the summer season begins. The year marker 150 on the price board 30 should stay on one and the season marker 151 should be placed on summer, as shown in FIG. 3. The dice silo 10 is again used to determine prices for the summer of year one and is placed on the left side of the price board 30. The commodity dealer uses the dice silo 10 to determine and mark price changes on the left half 32 of the board 30 based on the dice roll. The farmers are agian set free to buy and sell from both sides of the board following the rules stated above.

When all purchases and sales desired to be made by the players for the summer are completed and recorded on the farm record sheet, the fall season begins. The year marker 150 stays on year one and the season marker 151 is moved to fall. The dice silo 10 is used to determine the fall prices. The silo 10 is placed on the right-hand side of the board 30 and the commodities dealer changes the right half 31 of the board 30 based on the dice roll. As was done in the spring, the bankder again pays milk and egg money and collects the land taxes if required. Also, each fall, the banker collects loan interest payments of $5,000.00 from each farmer. Money changing hand for milk, eggs, taxes and interest are recorded on record 60 at 65,66, 67 and 68 respectively.

Once the banker has collected the land taxes and interest payments and paid out the milk and egg money and these transactions are recorded, the farmers are free to harvest their crops and either sell them or store them in the homestead crop storage area 58 (see FIG. 5) in order to wait for better prices in the future. If the price board 30 indicates "no harvest" for wheat, corn or soybeans, this means that the crop is a total loss and is returned to the commodities dealer without compensation. In years two through five, any stored crops may be sold for top price (i.e., the prices reflected in column 6 on the right-hand side) when a "no harvest" results from the dice roll. Farmers are also free to buy and sell other commodities following the rules stated above.

The game is continued to be played for a five-year period. Year marker 150 is moved to reflect year changes. Transactions for years two through five are also recorded on the farm record sheet 60. At the end of the five years, the final reckoning takes place. Column 160 on the back of the farm record sheet 60 shown in FIG. **6*b* is used for the final reckoning. The total value of all of the commodities owned at the end of year five plus the cash on hand are recorded in the final reckoning column and totaled. The values to be used for livestock, land and crops are the full price reflected on the price board 30 for the summer and fall of year five. The values to be used for extra builidings and extra field equipment are determined by one-half the price shown on the price board 30** for summer and fall of year five. The seed stored in the homestead itself has no value. Once the total assets have been determined, the $50,000.00 loan is subtracted to arrive at a final total and the player with the highest final total wins the game.

To promote realism, the game of the present invention requires the farmer to take into account the possibilities of "dumping", forced sale" and "bankruptcy". Dumping takes place when a farmer returns commodities to the commodity dealer without compensation. A farmer is permitted to dump voluntarily at any time during the course of the game.

A forced sale takes place if a farmer does not have enough cash to pay taxes or loan interests. In such situations, the farmer is forced to sell crops, livestock or land at full price and/or buildings and field equipment at half price to raise the money needed. It may be necessary to "dump" in order to achieve a forced sale. For example, if a farmer is unable to pay loan interest and his total assets are four units of chickens and one extra chicken coop and chickens are marked "no trading", the farmer must sell his extra chicken coop at half price. To do this, he must dump three units of chickens becuase only one unit can be covered by the homestead coop.

Finally, it may be advantageous for a farmer to declare bankruptcy. This may be done at any time that the farmer's assets (excluding the homestead) are $10,000.00 or less. When he declares bankruptcy, the farmer returns all commodities to the commodity dealer and all cash to the bank. The banker cancels the first $50,000.00 loan and all unpaid interest on it as well as any unpaid taxes. The banker issues a new $50,000.00 loan and the farmer resumes play with the original homestead.

From the foregoing, it can be seen that applicant has provided a game apparatus which realistically simulates the management decisions which must be made to operate a farm. While the invention is susceptible to various modifications and alternative constructions, certain illustrative embodiments thereof have been shown in the drawings and described in detail. It should be understood, however, that there is no intention to limit the invention to the specific forms disclosed but, on the contrary, the invention is to cover all modifications, alternative constructions, and equivalents falling within the spirit and scope of the invention.

I claim:

1. A game playing apparatus which promotes simulation of farm managment techniques comprising:

(a) a plurality of cards representing assets of various types;

(b) means for randomly establishing, at various points during the course of the game, a plurality of variables wherein said means include a support stand, a plurality of dice, a faceplate having a first portion through which the dice can be seen and at least one other portion which is subdivided, each subdivision being approximately the same height as a single die and being labeled to identify the subdivision with a particular asset, a dice receiving chamber for aligning and orienting the dice behind the first portion of the faceplate so that only one side of each die is exposed through the faceplate and each die is associated with only one subdivision of at least one other portion of the faceplate, a dice storage and shaker chamber, and an annular opening between the dice receiving chamber and the dice storage and shaker chamber;

(c) means for displaying the values of at least some of the variables wherein said means include a board having at least one set of x and y axes, one of said axes being divided into six portions and labeled one through six and the other axis being divided into the same number of portions as are dice in the variable establishing means and having the same labels or designations as the subdivisions on the faceplate of the variable establishing means, a plurality of spaces established by the x and y coordinates which are labeled to assign values to the coordinates and a plurality of markers, one for each portion, along one of the axes which are in slidable engagement with the board and movable parallel to the other axes for designating the proper space defined by the x and y coordinates;

(d) play money for conducting transactions involving the assets; and (e) means for recording the transactions.

* * * * *